US010877418B2

(12) United States Patent
Hagiwara et al.

(10) Patent No.: US 10,877,418 B2
(45) Date of Patent: Dec. 29, 2020

(54) IMAGE FORMING APPARATUS INCLUDING A FIRST DETECTION DEVICE AND A SECOND DETECTION DEVICE

(71) Applicant: FUJI XEROX CO., LTD., Tokyo (JP)

(72) Inventors: Chihiro Hagiwara, Kanagawa (JP); Satoshi Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/669,605

(22) Filed: Oct. 31, 2019

(65) Prior Publication Data

US 2020/0310304 A1 Oct. 1, 2020

(30) Foreign Application Priority Data

Apr. 1, 2019 (JP) ..... 2019-069786

(51) Int. Cl.
*G03G 15/01* (2006.01)
*G03G 15/00* (2006.01)

(52) U.S. Cl.
CPC ..... *G03G 15/5058* (2013.01); *G03G 15/0189* (2013.01); *G03G 2215/00059* (2013.01); *G03G 2215/0122* (2013.01)

(58) Field of Classification Search
CPC ..... G03G 15/0189; G03G 15/1605; G03G 15/5054; G03G 15/5058; G03G 2215/00059; G03G 2215/0119; G03G 2215/0122
USPC ..... 399/49, 66, 299, 302, 303
See application file for complete search history.

(56) References Cited

U.S. PATENT DOCUMENTS 6,188,861 B1 * 2/2001 Parker ..... G03G 15/0184 399/299
8,682,233 B2 3/2014 Dejong et al.
2006/0188299 A1 * 8/2006 Matsumoto ..... G03G 13/013 399/302
2011/0076045 A1 * 3/2011 Sobue ..... G03G 15/5062 399/81
2012/0207518 A1 * 8/2012 Krucinski ..... G03G 15/5058 399/301

(Continued)

FOREIGN PATENT DOCUMENTS

JP 09274356 A * 10/1997
JP 2005070441 A * 3/2005

*Primary Examiner* — Robert B Beatty
(74) *Attorney, Agent, or Firm* — Sughrue Mion, PLLC

(57) ABSTRACT

An image forming apparatus includes image forming units, secondary transfer units, and first and second detection devices. Each image forming unit includes image forming devices, and a primary intermediate transfer body. Toner images formed by the image forming devices are primarily transferred to the primary intermediate transfer body. The secondary transfer units are provided for the image forming units, respectively. Each secondary transfer unit is configured to secondarily transfer the toner images on a corresponding one of the primary intermediate transfer bodies to a transfer body. The first detection device is configured to detect the toner images downstream of the most downstream secondary transfer position. The second detection device is provided in at least one of the image forming units. The second detection device is configured to detect the toner images between the most downstream primary transfer position in the primary intermediate transfer body and a secondary transfer position.

21 Claims, 7 Drawing Sheets

(56) References Cited

U.S. PATENT DOCUMENTS

| | | | | |
|---|---|---|---|---|
| 2020/0073293 | A1* | 3/2020 | Ichiki | G03G 15/1615 |
| 2020/0096912 | A1* | 3/2020 | Goda | G03G 15/1605 |
| 2020/0096915 | A1* | 3/2020 | Hashimoto | G03G 15/0189 |

* cited by examiner

IMAGE FORMING APPARATUS INCLUDING A FIRST DETECTION DEVICE AND A SECOND DETECTION DEVICE

CROSS-REFERENCE TO RELATED APPLICATIONS

This application is based on and claims priority under 35 USC 119 from Japanese Patent Application No. 2019-069786 filed Apr. 1, 2019.

BACKGROUND

(i) Technical Field

The present disclosure relates to an image forming apparatus.

(ii) Related Art

U.S. Pat. No. 8,682,233 discloses an image forming apparatus in which two units each having four marking stations are disposed on a sheet transport belt.

SUMMARY

There is an image forming apparatus that includes plural image forming units each having a primary intermediate transfer body to which toner images formed by plural image forming devices are primarily transferred. The toner images on the primary intermediate transfer bodies of the image forming units are secondarily transferred to a transfer body. In the image forming apparatus having such a configuration, if a detection device for detecting toner images for various adjustments only detects a toner image downstream of a secondary transfer position of the most downstream image forming unit, only a toner image influenced by a secondary transfer unit can be detected in any of the image forming units.

Aspects of non-limiting embodiments of the present disclosure relates to an image forming apparatus that includes plural image forming units each having a primary intermediate transfer body to which toner images formed by plural image forming devices are primarily transferred and that secondarily transfers the toner images on the primary intermediate transfer bodies of the plural image forming units to a transfer body in which a detection device configured to detect a toner image not influenced by a secondary transfer unit in at least one of the image forming units, compared with a case of detecting only a toner image downstream of a secondary transfer position of the most downstream image forming unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: plural image forming units each including plural image forming devices, and a primary intermediate transfer body to which toner images formed by the plural image forming devices are primarily transferred; plural secondary transfer units that are provided for the plural image forming units, respectively, each of the secondary transfer units being configured to secondarily transfer the toner images on a corresponding one of the primary intermediate transfer bodies to a transfer body; a first detection device configured to detect the toner images downstream of the most downstream secondary transfer position; and a second detection device provided in at least one of the image forming units, the second detection device being configured to detect the toner images between the most downstream primary transfer position in the primary intermediate transfer body and a secondary transfer position.

BRIEF DESCRIPTION OF THE DRAWINGS

Exemplary embodiment(s) of the present disclosure will be described in detail based on the following figures, wherein.

DETAILED DESCRIPTION

Exemplary Embodiment

An image forming apparatus according to an exemplary embodiment of the present disclosure will be described. In an image forming apparatus 10 shown in FIG. 1, a width direction thereof is set as an X direction, a height direction thereof is set as a Y direction, and a depth direction thereof is set as a Z direction. The X, Y, and Z directions are respectively indicated by arrows X, Y, and Z. When it is necessary to distinguish one side from the other side in each of the X direction, the Y direction, and the Z direction, a right side of the image forming apparatus 10 shown in FIG. 1 will be referred to as a +X side, a left side thereof as a −X side, an upper side thereof as a +Y side, a lower side thereof as a −Y side, a front side thereof as a +Z side, and a rear side thereof as a −Z side. In the present exemplary embodiment, a recording paper P is used as an example of a recording medium. An upstream side in a transport direction in which the recording paper P is transported is referred to as an "upstream side in the transport direction", and a downstream side in the transport direction is referred to as a "downstream side in the transport direction". The image forming apparatus 10 according to the present exemplary embodiment is a so-called single pass system. Printing is performed by the recording paper P passing in front of an image forming unit 30 and an image forming unit 50 (which will be described later) one time.

[Overall Configuration]

First, an overall configuration of the image forming apparatus will be described.

Figure 1:
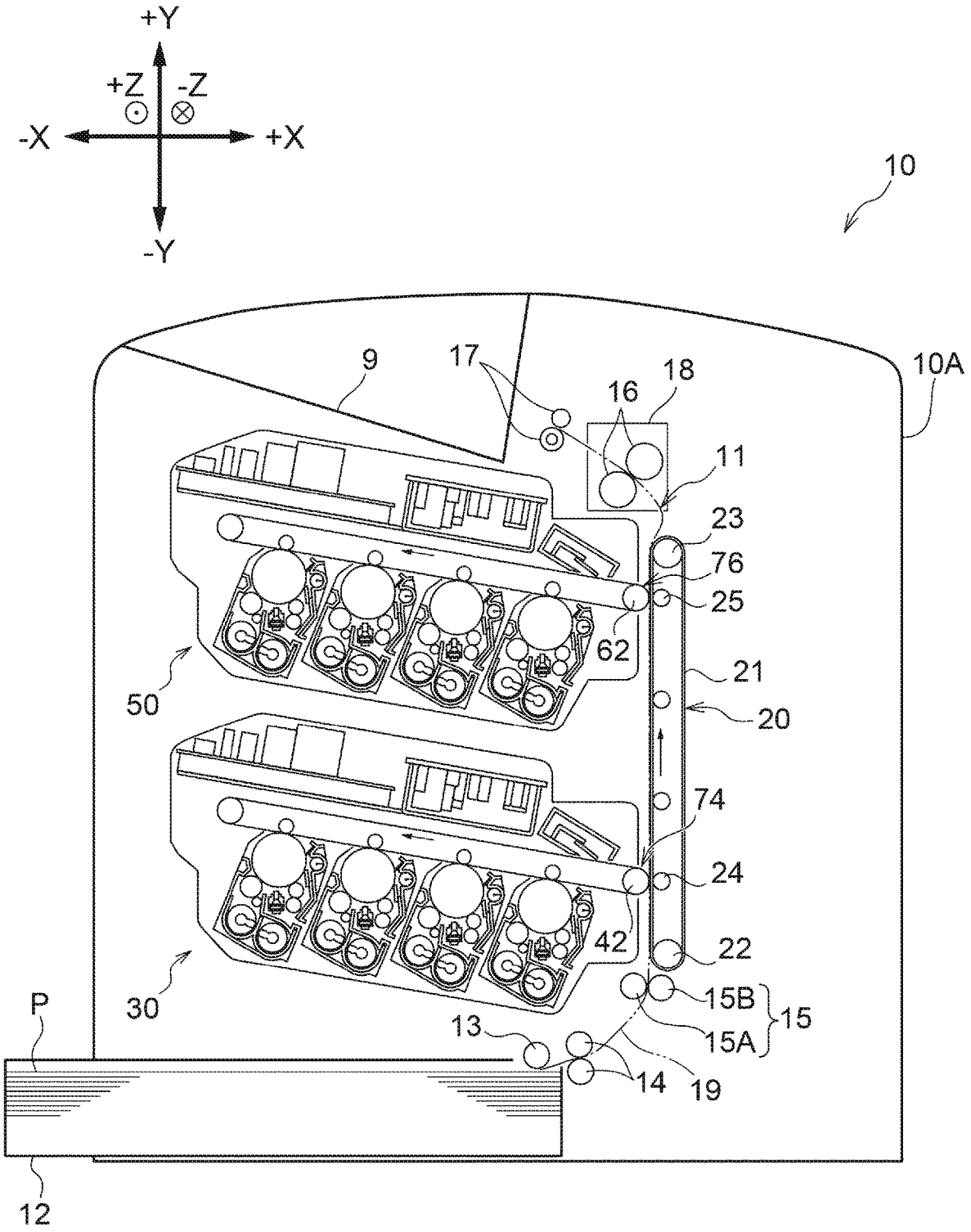
FIG. 1 is a configuration diagram of an image forming apparatus according to an exemplary embodiment.

As shown in FIG. 1, the image forming apparatus 10 includes an accommodating unit 12 in which the recording paper P is accommodated, a transport unit 11 that transports the recording paper P along a transport path 19, the image forming unit 30 and the image forming unit 50 that form toner images to be transferred to the recording paper P.

The accommodating unit 12 can be pulled out from an image forming apparatus main body 10A that is a body of the image forming apparatus 10. The accommodating unit 12 accommodates the recording paper P therein.

The transport unit 11 includes a delivery roller 13, transport rollers 14, a pair of registration rollers 15, a transport belt device 20, a fixing device 18, and discharge rollers 17 in this order from the upstream side in the transport direction.

The delivery roller 13 sends out the recording paper P accommodated in the accommodating unit 12 to the transport path 19 constituting the transport unit 11. The transport rollers 14 transport the recording paper P along the transport path 19.

The pair of registration rollers 15 transports the recording paper P transported by the transport rollers 14 to an upstream secondary transfer position TJ2, which will be described later. The pair of registration rollers 15 sandwiches the recording paper P between a registration roller 15A and a pinch roller 15B, and transports the recording paper P to the downstream side in the transport direction.

The transport belt device 20 transports the recording paper P to the downstream side in the transport direction along the transport path 19 while the toner images formed by the image forming units 30 and 50 are transferred onto the recording paper P. The transport belt device 20 will be described in detail later.

The fixing device 18 includes a pair of fixing rollers 16. When the recording paper P to which the toner image is transferred passes between the pair of fixing rollers 16, the fixing device heats and pressurizes the recording paper P, and fixes the toner image on the recording paper P.

The discharge rollers 17 discharge the recording paper P, on which the toner image is fixed by the fixing device 18, to a discharge unit 9.

The image forming unit 30 and the image forming unit 50 are arranged side by side in the vertical direction. In the present exemplary embodiment, the image forming unit 50 is disposed above the image forming unit 30. From another viewpoint, the image forming unit 50 is disposed downstream of the image forming unit 30 in the transport direction.

Figure 2:
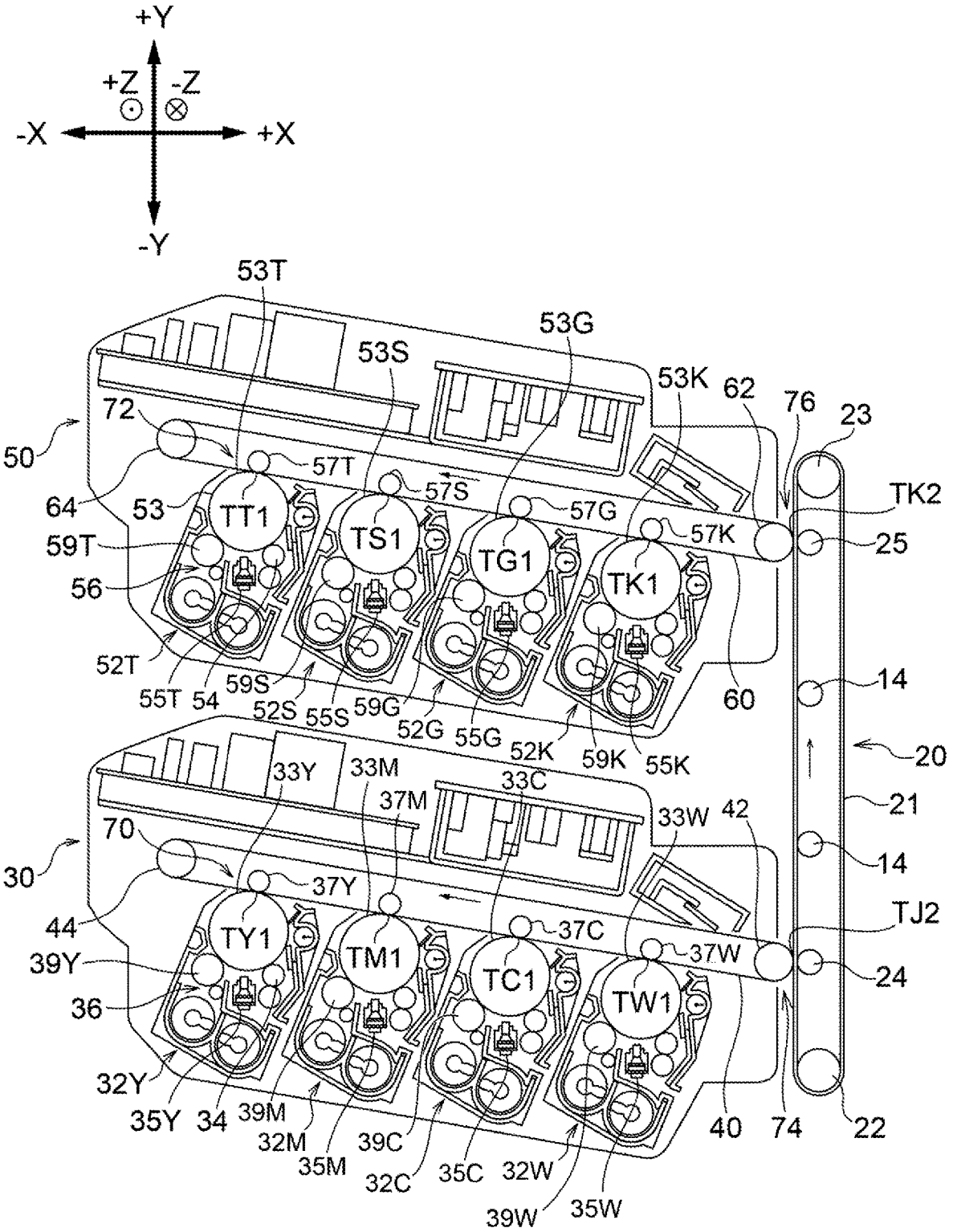
FIG. 2 is a partially enlarged view of FIG. 1.

As shown in FIG. 2, the image forming unit 30 includes four image forming devices 32 and an endless intermediate transfer belt 40. The intermediate transfer belt 40 is configured such that toner images formed by the four image forming devices 32 are transferred thereto. The intermediate transfer belt 40 is mounted to be rotatable counterclockwise as viewed from the front side of the paper of FIG. 2.

The four image forming devices 32 include an image forming device 32W that forms a white toner image, an image forming device 32M that forms a magenta toner image, an image forming device 32C that forms a cyan toner image, and an image forming device 32Y that forms a yellow toner image. Further, the four image forming devices 32 are arranged in an order of the image forming device 32Y, the image forming device 32M, the image forming device 32C, and the image forming device 32W, from an upstream side (from the closest to a support roller 44 which will be described later) in a rotation direction in which the intermediate transfer belt 40 rotates. Hereinafter, the upstream side in the rotation direction of the intermediate transfer belt 40 is referred to as an "upstream side in the rotation direction", and a downstream side in the rotation direction is referred to as a "downstream side in the rotation direction". That is, among the image forming devices 32, the image forming device 32W is disposed most downstream in the rotation direction.

When it is unnecessary to distinguish Y, M, C, and W from each other, the suffixes Y, M, C, and W will be omitted.

Each image forming device 32 includes a photoconductor 33, a charging member 34 that charges a surface of the photoconductor 33, an exposure device 35 that irradiates the charged photoconductor 33 with exposure light, and a developing device 36 that develops an electrostatic latent image formed by the irradiation of the exposure light to visualize the electrostatic latent image as a toner image.

The developing devices 36 include developing rollers 39Y, 39M, 39C, and 39W, respectively. A development bias is applied to each developing device 36 by a power supply device 159 (see FIG. 3).

Primary transfer rollers 37Y, 37M, 37C, and 37W are disposed at positions where the primary transfer rollers 37Y, 37M, 37C, and 37W face the photoconductors 33 across the intermediate transfer belt 40. Each of the primary transfer rollers 37Y, 37M, 37C, and 37W transfer a toner image formed by a corresponding one of the image forming devices 32 to the intermediate transfer belt 40. The intermediate transfer belt 40 is wound around the support roller 44 and a backup roller 42. The support roller 44 supports the intermediate transfer belt 40. The backup roller 42 is disposed in an upstream secondary transfer unit 74, which will be described later. A primary transfer unit 70 includes the photoconductors 33, the primary transfer rollers 37, and the intermediate transfer belt 40. Primary transfer positions TY1, TM1, TC1, and TW1 are defined between the photoconductors 33Y, 33M, 33C, and 33W and the intermediate transfer belt 40, respectively.

The image forming unit 50 has the same configuration as that of the image forming unit 30 except that colors of images to be formed are different.

The image forming unit 50 includes four image forming devices 52 and an intermediate transfer belt 60. The intermediate transfer belt 60 is configured such that toner images formed by the four image forming devices 52 are transferred thereto. The intermediate transfer belt 60 is mounted to be rotatable counterclockwise as viewed from the front side of the paper of FIG. 2.

The image forming devices 52 have the same configurations as those of the image forming devices 32 of the image forming unit 30 except that colors of images to be formed are different. The intermediate transfer belt 60 and primary transfer rollers 57 (which will be described later) have the same configurations as those of the intermediate transfer belt 40 and the primary transfer rollers 37 of the image forming unit 30. Other components constituting the image forming unit 50 are the same as those of the image forming unit 30.

The image forming devices 52 include an image forming device 52K that forms a black toner image, an image forming device 52G that forms a gold toner image, an image forming device 52S that forms a silver toner image, and an image forming device 52T that forms a transparent toner image. Further, the four image forming devices 52 are arranged in an order of the image forming device 52T, the image forming device 52S, the image forming device 52G, and the image forming device 52K, from an upstream side (from the closest to a support roller 64 which will be described later) in a rotation direction. That is, among the image forming devices 52, the image forming device 52K is disposed most downstream in the rotation direction, the image forming device 52G and the image forming device 52S are disposed on upstream of the image forming device 52K in the rotation direction, and the image forming device 52T is disposed most upstream in the rotation direction.

When it is unnecessary to distinguish T, S, G, and K from each other, the suffixes T, S, G, and K will be omitted.

Each image forming device 52 includes a photoconductor 53, a charging member 54, an exposure device 55, and a developing device 56.

The developing devices 56 includes developing rollers 59T, 59S, 59G, and 59K, respectively. A development bias is applied to each developing device 56 by the power supply device 159 (see FIG. 3).

Primary transfer rollers 57T, 57S, 57G, and 57K are disposed at positions where the primary transfer rollers 57T, 57S, 57G, and 57K face the photoconductors 53 across the intermediate transfer belt 60. The intermediate transfer belt 60 is wound around the support roller 64 and a backup roller 62. The backup roller 62 is disposed in a downstream secondary transfer unit 76, which will be described later. A primary transfer unit 72 includes the photoconductors 53, the primary transfer rollers 57, and the intermediate transfer belt 60. Primary transfer positions TT1, TS1, TG1, and TK1 are defined between the photoconductors 53Y, 53M, 53C, and 53W and the intermediate transfer belt 60, respectively.

Figure 3:
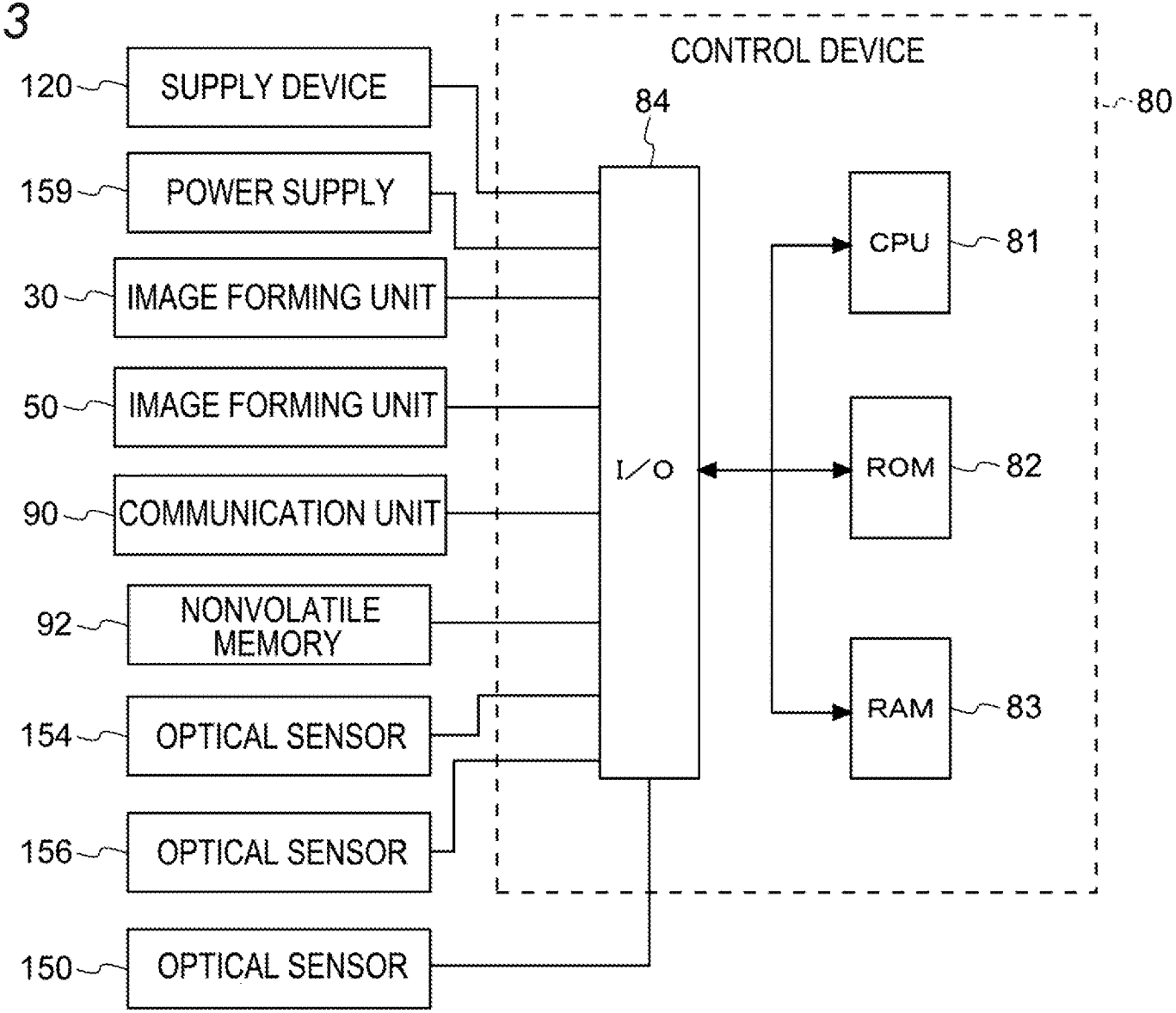
FIG. 3 is a block diagram showing a configuration of a control device and the like according to the present exemplary embodiment.
Figure 4:
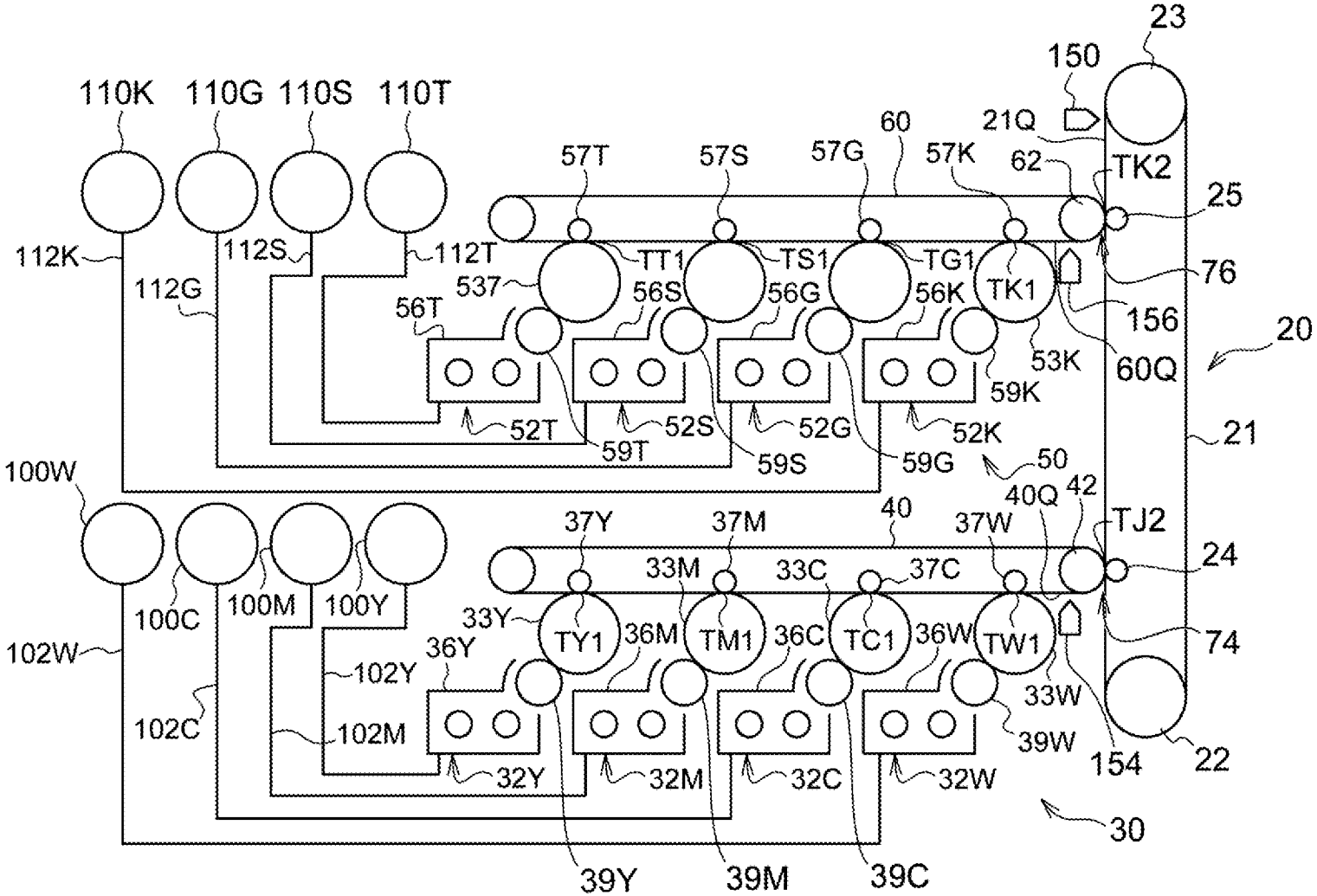
FIG. 4 is a schematic view schematically showing a configuration of the image forming apparatus according to the exemplary embodiment.

As shown in FIG. 4, plural toner cartridges 100, which accommodate toners corresponding to the colors, are respectively connected to the developing devices 36 of the image forming devices 32 forming toner images of the colors in the image forming unit 30, via supply paths 102; and plural toner cartridges 110, which accommodate toners corresponding to the colors, are respectively connected to the developing devices 56 of the image forming devices 52 forming toner images of the colors in the image forming unit 50, via supply paths 112. The toners accommodated the toner cartridges 100 and 110 are appropriately supplied to the developing devices 36 and 56 for the respective colors via the supply paths 102 and 112 by a supply device 120 (see FIG. 3) operates. The supply device 120 is provided in the supply paths 102 and 112. The supply device 120 (see FIG. 3) is capable of supplying the toners from the toner cartridges 100Y, 100M, 100C, 100W, 110T, 110S, 110G, and 110K to the respective developing devices 36Y, 36M, 36C, 36W, 56C, 56T, 56G, and 56K, separately.

Next, the transport belt device 20 will be described in detail.

As shown in FIG. 2, the transport belt device 20 includes an endless transport belt 21, support rollers 22 and 23 that support the transport belt 21, the transport rollers 14, and secondary transfer rollers 24 and 25. The secondary transfer roller 24 is disposed at a position where the secondary transfer roller 24 faces the backup roller 42 across the intermediate transfer belt 40. The secondary transfer roller 25 is disposed at a position where the secondary transfer roller 25 faces the backup roller 62 across the intermediate transfer belt 60.

The secondary transfer roller 24 transfers a toner image formed on the intermediate transfer belt 40 of the image forming unit 30 to the recording paper P, with the recording paper P and the transport belt 21 sandwiched between the secondary transfer roller 24 and the backup roller 42. Similarly, the secondary transfer roller 25 transfers a toner image formed on the intermediate transfer belt 60 of the image forming unit 50 to the recording paper P, with the recording paper P and the transport belt 21 sandwiched between the secondary transfer roller 25 and the backup roller 62.

The secondary transfer unit 74 includes the backup roller 42, the secondary transfer roller 24, and the intermediate transfer belt 40. The secondary transfer unit 76 includes the backup roller 62, the secondary transfer roller 25, and the intermediate transfer belt 60.

A transfer bias is applied to the secondary transfer rollers 24 and 25 by the power supply device 159 (see FIG. 3).

The intermediate transfer belt 40 of the image forming unit 30 and the transport belt 21 defines the secondary transfer position TJ2 therebetween. The intermediate transfer belt 60 of the image forming unit 50 and the transport belt 21 defines a secondary transfer position TK2 therebetween. The secondary transfer position TK2 is the most downstream secondary transfer position.

Further, the transport belt device 20 includes a belt cleaning device (not shown) that cleans the transport belt 21. The belt cleaning device (not shown) performs cleaning at a position upstream of the most downstream secondary transfer position TK2 in a rotation direction and downstream of the most upstream secondary transfer position TJ2 in the rotation direction. On the transport belt 21, a position to be cleaned by the belt cleaning device (not shown) will be referred to as a cleaning position CL.

Here, the image forming devices 32 of the image forming unit 30 and the image forming devices 52 of the image forming unit 50 form first patch images BC1 for toner supply adjustment (see FIG. 5A), second patch images BC2 for density adjustment (see FIG. 5B), and third patch images BC3 for positional deviation adjustment (see FIG. 5C) with the toners of the colors. Suffixes Y, M, C, W, T, S, G, and K, which follow the reference signs of the first patch image BC1, the second patch image BC2, and the third patch image BC3, indicate the colors of the toners. When it is unnecessary to distinguish Y, M, C, W, T, S, G, and K from each other, the suffixes will be omitted.

In the present exemplary embodiment, the first patch images BC1 for toner supply adjustment (see FIG. 5A), the second patch images BC2 for density adjustment (see FIG. 5B), and the third patch images BC3 for positional deviation adjustment (see FIG. 5C) are formed on the intermediate transfer belts 40 and 60, and are secondarily transferred to the transport belt 21 finally. The first patch images BC1 for toner supply adjustment (see FIG. 5A), the second patch images BC2 for density adjustment (see FIG. 5B), and the third patch images BC3 for positional deviation adjustment (see FIG. 5C) will be simply referred to as "patch images BC" when it is unnecessary to distinguish BC1, BC2 and BC3 from each other.

As shown in FIG. 4, an optical sensor 150 is provided in the vicinity of an upper end portion of the transport belt 21. The optical sensor 150C is an example of a first detection device that detects the patch images BC secondarily transferred to the transport belt 21. The optical sensor 150 detects the patch images BC at a flat portion 21Q, which is located downstream of the most downstream secondary transfer position TK2 and between the secondary transfer position TK2 and an upper support roller 23 on which the transport belt 21 is wound. In the present exemplary embodiment, the optical sensor 150 detects the patch images BC in the vicinity of the support roller 23 in the flat portion 21Q.

In the present exemplary embodiment, the optical sensor 150 may be disposed at such a position that the optical sensor 150 can detect the patch images BC upstream of the most downstream secondary transfer position TK2 in the rotation direction and upstream of the cleaning position CL in the rotation direction.

Optical sensors 154 and 156 are provided in the image forming unit 30 and the image forming unit 50, respectively. The optical sensors 154 and 156 are examples of second detection devices that detect the patch images BC primarily transferred to the intermediate transfer belts 40 and 60.

The optical sensor 154 provided in the image forming unit 30 detects the patch images BC in the vicinity of the backup roller 42 in a flat portion 40Q of the intermediate transfer belt 40. The flat portion 40Q is located between the most downstream primary transfer position TW1 and the backup roller 42. The optical sensor 156 provided in the image forming unit 50 detects the patch images BC in the vicinity of the backup roller 62 in a flat portion 60Q of the intermediate transfer belt 60. The flat portion 60Q is located between the most downstream primary transfer position TK1 and the backup roller 62. Alternatively, the optical sensor 150 detects the patch images BC at a position overlapping the support roller 23 as viewed from a horizontal direction perpendicular to an axial direction.

The optical sensor 150 is disposed at such a position that the optical sensor 150 can detect the patch images BC downstream of the most downstream secondary transfer unit 76. From another viewpoint, the optical sensor 150 is disposed such at a position that the optical sensor 150 can detect all the patch images BC formed by all the image forming devices 32Y, 32M, 32C, 32W, 52T, 52S, 52G, and 52K.

In the present exemplary embodiment, the optical sensor 150 may be disposed at such a position that the optical sensor 150 can detect the patch images BC upstream of the most downstream secondary transfer position TK2 in the rotation direction and upstream of the cleaning position CL in the rotation direction.

The optical sensor 150, the optical sensor 154, and the optical sensor 156 in the present exemplary embodiment have the same structure. In the present exemplary embodiment, as shown in FIG. 6, the optical sensor 150 includes three detectors 150A, 150B, and 150C, arranged side by side at intervals along an axial direction, that is, a width direction of the paper of FIG. 6; the optical sensor 154 includes three detectors 154A, 154B, and 154C, arranged side by side at intervals along the axial direction; and the optical sensor 156 includes three detectors 156A, 156B, and 156C, arranged side by side at intervals along the axial direction.

Figures 5A, 5B, 5C:
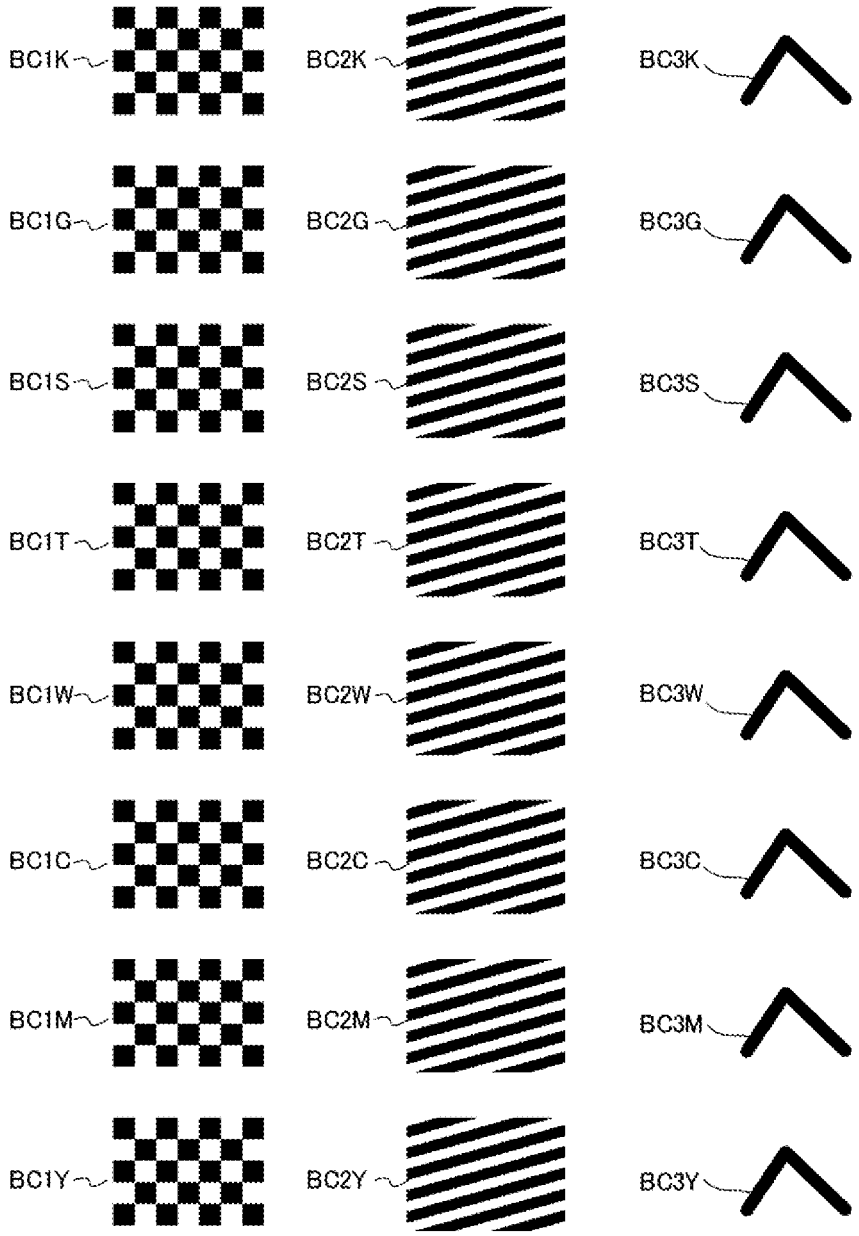
FIG. 5A shows a first patch image for toner supply adjustment.
FIG. 5B shows a second patch image for density adjustment.
FIG. 5C shows a third patch image for positional deviation adjustment.
Figure 6:
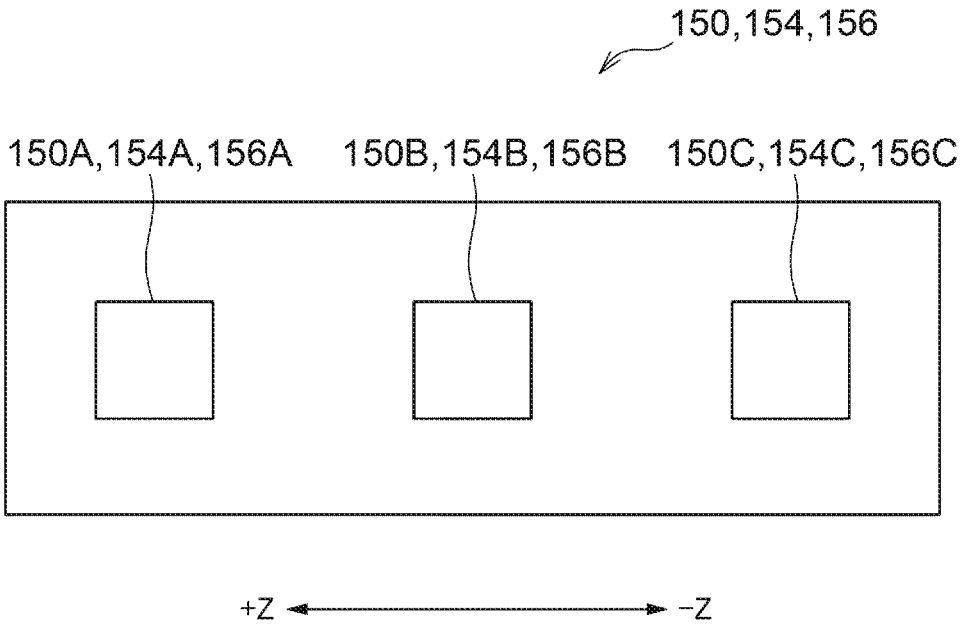
FIG. 6 is a configuration diagram of an optical sensor.

The first patch image BC1 for toner supply adjustment (see FIG. 5A), the second patch image BC2 for density adjustment (see FIG. 5B), and the third patch image BC3 for positional deviation adjustment (see FIG. 5C) each includes three columns of patch images so that the three columns respectively correspond to the detectors 150A, 154A, and 156A, the detectors 150B, 154B, and 156B, and the detectors 150C, 154C, and 156C shown in FIG. 6. Each column includes patch images of K, G, S, T, W, C, M, and Y arranged in this order.

[Control Device]

Next, a control device 80 that controls operations of the image forming apparatus 10 will be described with reference to FIG. 3.

As shown in FIG. 3, the image forming unit 30, the image forming unit 50, a communication unit 90, a nonvolatile memory 92, the supply device 120, the power supply device 159, and the optical sensors 150, 154, and 156 are electrically connected to the control device 80.

As shown in FIG. 3, in the control device 80, a Central Processing Unit (CPU) 81, a Read Only Memory (ROM) 82, a Random Access Memory (RAM) 83, and an input/output interface (I/O) 84 are connected to each other via a bus.

Here, the ROM 82 stores an image formation control program (not shown) to be executed by the CPU 81. The CPU 81 reads the image formation control program (not shown) from the ROM 82 and loads the image formation control program (not shown) to the RAM 83 to execute a printing process with the image formation control program (not shown).

The image forming unit 30, the image forming unit 50, the communication unit 90, and the nonvolatile memory 92 are connected to the I/O 84. The communication unit 90 is an interface for mutual data communication between a terminal device such as a personal computer (not shown) and the image forming apparatus 10. The nonvolatile memory 92 stores information that is necessary for the image forming apparatus 10 to execute an image forming operation.

The control device 80 performs various kinds of control for forming toner images on the intermediate transfer belt 40 (see FIG. 2 and the like) by the image forming devices 32 (see FIG. 2 and the like) of the colors in the image forming unit 30. Similarly, the control device 80 performs various kinds of control for forming toner images on the intermediate transfer belt 60 (see FIG. 2 and the like) by the image forming devices 52 (see FIG. 2 and the like) of the colors in the image forming unit 50.

In addition, the control device 80 controls the development bias applied to the developing rollers 39Y, 39M, 39C, 39W, 59T, 59S, 59G, and 59K (see FIG. 2 and the like) of the developing devices 36 and 56 by the power supply device 159. Further, the control device 80 controls the transfer bias applied to the secondary transfer rollers 24 and 25 (see FIG. 2 and the like) by the power supply device 159.

In addition, the control device 80 controls a supply timing, a supply period, a supply amount, and the like in supply of the toners of the colors from the toner cartridges 100Y, 100M, 100C, 100W, 110T, 110S, 110G, and 110K (see FIG. 4) to the respective developing devices 36Y, 36M, 36C, 36W, 56T, 56S, 56G, and 56K (see FIG. 2 and the like), using the supply device 120.

Further, the control device 80 receives inputs of detection values obtained by the optical sensor 150, the optical sensor 154, and the optical sensor 156 detecting the patch images BC. Further, based on these detection values, the control device 80 controls timings at which toner images are formed on the intermediate transfer belts 40 and 60 (see FIG. 2 and the like) of the image forming units 30 and 50. Specifically, based on these detection values, the control device 80 controls timings of exposure of the exposure devices 35 and 55 (see FIG. 2 and the like) and other timing, controls the toner supply of the toners of the colors with the supply device 120, and controls the development bias applied to the developing rollers 39 and 59 (see FIG. 2 and the like) and the transfer bias applied to the secondary transfer rollers 24 and 25 (see FIG. 2 and the like) with the power supply device 159.

The various kinds of control based on the detection values obtained by the optical sensor 150, the optical sensor 154, and the optical sensor 156 detecting the patch images BC will be described later.

[Image Forming Process]

Next, an outline of an image forming process of the image forming apparatus 10 will be described.

First, the control device 80 controls the image forming devices 32 such that a toner image is formed on the intermediate transfer belt 40 of the image forming unit 30. Similarly, the control device 80 controls the image forming devices 52 such that a toner image is formed on the intermediate transfer belt 60 of the image forming unit 50.

Specifically, the control device 80 controls the power supply device 159 to apply a voltage to the charging members 34 and 54, and the charging members 34 and 54 to which the voltage is applied charge the surfaces of the photoconductors 33 and 53 to a predetermined potential. Subsequently, based on image data obtained via the communication unit 90, the control device 80 controls the exposure devices 35 and 55 to irradiate the surfaces of the photoconductors 33 and 53 charged by the charging members 34 and 54 with the exposure light, to form electrostatic latent images. Accordingly, the electrostatic latent images corresponding to the image data are formed on the surfaces of the photoconductors 33 and 53.

Next, the control device 80 controls the developing devices 36 and 56 to develop the electrostatic latent images formed by the exposure devices 35 and 55 to visualize the electrostatic latent images as toner images. Further, the control device 80 controls the primary transfer rollers 37 and 57 to transfer the toner images formed on the surfaces of the photoconductors 33 and 53 of the colors onto the intermediate transfer belts 40 and 60 in a superimposed manner.

In this manner, in the image forming unit 30, for example, a toner image having superimposed yellow (Y), magenta (M), cyan (C), and white (W) toners is formed on the intermediate transfer belt 40. Similarly, in the image forming unit 50, for example, a toner image having superimposed black (K), gold (G), silver (S), and transparent (T) toners is formed on the intermediate transfer belt 60.

Here, the recording paper P sent from the accommodating unit 12 to the transport path 19 by the delivery roller 13 is sent out to the upstream secondary transfer position TJ2 in the transport direction after a transport timing is adjusted by the pair of registration rollers 15 based on control of the control device 80. In the secondary transfer position TJ2, the recording paper P is transported between the backup roller 42 and the secondary transfer roller 24, to thereby transfer the toner image on an outer circumferential surface of the intermediate transfer belt 40 to the recording paper P. Further, the recording paper P to which the toner image is transferred is transported toward the downstream side in the transport direction and reaches the downstream secondary transfer position TK2 in the transport direction.

At this time, the control device 80 adjusts the timing at which image formation is started such that the toner image formed on the intermediate transfer belt 60 of the image forming unit 50 is transferred and superimposed onto the toner image on the recording paper P transported from the upstream side in the transport direction.

The recording paper P, on which the toner images of the colors formed by the image forming unit 30 and the image forming unit 50 are superimposed and transferred, is fixed by the pair of fixing rollers 16 of the fixing device 18, and thereafter discharged to the discharge unit 9 provided in an upper portion of the image forming apparatus main body 10A by discharge rollers 17.

[Details of Various Kinds of Control Based on Detection Values Obtained by Optical Sensors Detecting Patch Images]

Next, details of various kinds of control by the control device 80 based on the detection values obtained by the optical sensor 150, the optical sensor 154, and the optical sensor 156 detecting the patch images BC will be described.

(Control of Process Control)

First, control of process control will be described. The control of the process control in the present exemplary embodiment refers to control of the transfer bias applied to the secondary transfer rollers 24 and 25, control of the development bias applied to the developing rollers 39 and 59, and control of the toner supply of the toners of the colors to the developing devices 36 and 56.

A detection value of the optical sensor 150 is represented by KS1, a detection value of the optical sensor 154 is represented by KS2, and a detection value of the optical sensor 156 is represented by KS3. The optical sensors 150, 154, and 156 detect positions of the first patch image BC and the second patch image BC2, and detect a density of the first patch image BC1.

Further, a detection value of the second patch image BC2 for density adjustment (see FIG. 5B) is used in controlling the transfer bias and the development bias. A detection value of the first patch image BC1 for toner supply adjustment (see FIG. 5A) is used in controlling toner supply.

(Overview of Process Control)

Here, an overview of the process control will be described with reference to the flowchart shown in FIG. 7. In this description, a case where KS2 as the detection value of the optical sensor 154 is used will be described as a representative example. A case where KS3 as the detection value of the optical sensor 156 is used will be indicated in parentheses.

Figure 7:
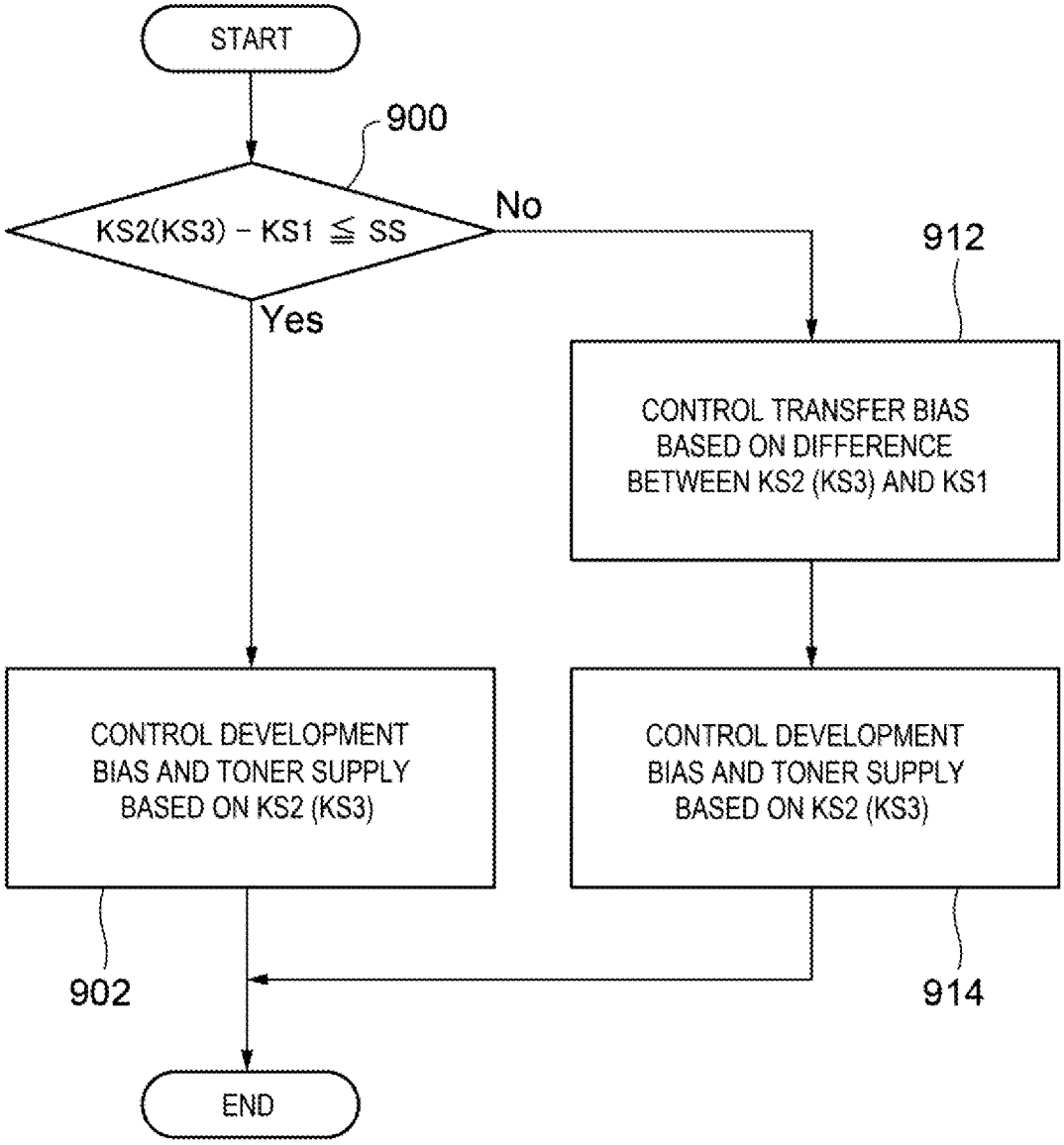
FIG. 7 is a flowchart showing an overview of process control.

In step 900 of the flowchart of FIG. 7, it is determined whether a difference between KS1 and KS2 (KS3) is equal to or less than a threshold SS.

When the difference is equal to or less than the threshold SS, the process proceeds to step 902. In step 902, the development bias applied to the developing rollers 39Y, 39M, 39C, and 39W (59T, 59S, 59G, and 59K), and toner supply to the developing devices 36Y, 36M, 36C, and 36W (56T, 56S, 56G, and 56K) are controlled based on KS2 (KS3).

When the difference between KS1 and KS2 (KS3) is greater than the threshold SS in step 900, the process proceeds to step 912.

In step 912, the transfer bias applied to the secondary transfer roller 24 (25) is controlled based on the difference between KS1 and KS2 (KS3). Then, the process proceeds to step 914.

In step 914, the development bias applied to the developing rollers 39Y, 39M, 39C, and 39W (59T, 59S, 59G, and 59K), and toner supply of the toners of the colors to the developing device 36Y, 36M, 36C, and 36W (56T, 56S, 56G, and 56K) are controlled based on KS2 (KS3).

An order of steps 912 and 914 may be reversed.

(Details of Control of Transfer Bias)

Next, the control of the transfer bias applied to the secondary transfer rollers 24 and 25 will be described in detail.

The second patch images BC2Y, BC2M, BC2C, and BC2W (see FIG. 5B) for density adjustment of Y, M, C, and W are used in controlling the transfer bias applied to the upstream secondary transfer roller 24.

In step 900, an average value of differences between the detection values KS1 of the optical sensor 150 for the second patch images BC2Y, BC2M, BC2C, and BC2W and the detection values KS2 of the optical sensor 154 for the second patch images BC2Y, BC2M, BC2C, and BC2W is compared with the threshold SS.

A difference between a detection value KS1 for a second patch image BC2 of a predetermined reference color, for example, the second patch image BC2W, and the detection value KS2 for the second patch image BC2 of the reference color may be compared with the threshold SS.

When the difference between the detection value KS1 and the detection value KS2 is equal to or less than the threshold SS in step 900, the transfer bias applied to the secondary transfer roller 24 is not changed.

When the difference between the detection value KS1 and the detection value KS2 is greater than the threshold SS in step 900, the process proceeds to step 912 in which the transfer bias applied to the secondary transfer roller 24 is adjusted based on the difference between the detection value KS1 and the detection value KS2. Specifically, the transfer bias applied to the secondary transfer roller 24 is increased as the difference between the detection value KS1 and the detection value KS2 increases.

The second patch images BC2T, BC2S, BC2G, and BC2K (see FIG. 5B) for density adjustment of T, S, G, and K are used in controlling the transfer bias applied to the downstream secondary transfer roller 25.

In step 900, an average value of differences between the detection values KS1 of the optical sensor 150 for the second patch images BC2T, BC2S, BC2G, and BC2K and the detection values KS3 of the optical sensor 156 for the second patch images BC2T, BC2S, BC2G, and BC2C is compared with the threshold SS.

A difference between a detection value KS1 for a second patch image BC2 of a predetermined reference color, for example, the second patch image BC2K, and the detection value KS3 for the second patch image BC2 of the reference color may be compared with the threshold SS.

When the difference between the detection value KS1 and the detection value KS3 is equal to or less than the threshold SS in step 900, the transfer bias applied to the secondary transfer roller 25 is not changed.

When the difference between the detection value KS1 and the detection value KS3 is greater than the threshold SS in step 900, the process proceeds to step 912 in which the transfer bias applied to the secondary transfer roller 25 is adjusted based on the difference between the detection value KS1 and the detection value KS3. Specifically, the transfer bias applied to the secondary transfer roller 25 is increased as the difference between the detection value KS1 and the detection value KS3 increases.

(Details of Control of Development Bias)

Next, control of the development bias applied to the developing rollers 39Y, 39M, 39C, 39W, 59T, 59S, 59G, and 59K will be described in detail.

The second patch images BC2Y, BC2M, BC2C, and BC2W (see FIG. 5B) for density adjustment of Y, M, C, and W are used in controlling the development bias applied to the developing rollers 39Y, 39M, 39C, and 39W of the developing devices 36 of the image forming devices 32 of the upstream colors.

In step 902 or step 914, the development bias applied to the developing rollers 39Y, 39M, 39C, and 39W is adjusted based on the detection values KS2 of the optical sensors 154 for the respective second patch images BC2Y, BC2M, BC2C, and BC2W. Specifically, the development bias applied to the developing rollers 39Y, 39M, 39C, and 39W is adjusted such that an image density of the second patch image BC2 is a predetermined reference density.

Second patch images BC2T, BC2S, BC2G, and BC2K (see FIG. 5B) for density adjustment of T, S, G, and K are used in controlling the development bias applied to the developing rollers 59T, 59S, 59G, and 59K of the image forming devices 52 in the downstream image forming unit 50.

In step 902 or step 914, the development bias applied to the developing rollers 59T, 59S, 59G, and 59K is adjusted based on the detection values KS3 of the optical sensor 156 for the respective second patch images BC2T, BC2S, BC2G, and BC2K. Specifically, the development bias applied to the developing rollers 59T, 59S, 59G, and 59K is adjusted such that the image density of the second patch image BC2 is the predetermined reference density.

(Details of Control of Toner Supply)

Next, control of the toners supplied to the developing devices 36Y, 36M, 36C, 36W, 56T, 56S, 56G, and 56K will be described in detail.

First patch images BC1Y, BC1M, BC1C, and BC1W (see FIG. 5A) for toner supply adjustment of Y, M, C, and W are used in controlling toner supply to the developing devices 36Y, 36M, 36C, and 36W of the image forming devices 32 in the upstream image forming unit 30.

In step 902 or step 914, supply amounts of toners supplied to the developing devices 36Y, 36M, 36C, and 36W are adjusted based on the detection values KS2 of the optical sensor 154 for the respective first patch images BC1Y, BC1M, BC1C, and BC1W. Specifically, when a detection value for the first patch image BC1 is less than a predetermined reference value, predetermined amounts of toners are supplied to the developing devices 36Y, 36M, 36C, and 36W according to the detection value.

First patch images BC1T, BC1S, BC1G, and BC1K (see FIG. 5A) for toner supply adjustment of T, S, G, and K are used in controlling the toner supply to the developing devices 56T, 56S, 56G, and 56K of the image forming devices 52 of the colors in the downstream image forming unit 50.

In step 902 or step 914, supply amounts of toners supplied to the developing devices 56T, 56S, 56G, and 56K are adjusted based on the detection values KS3 of the optical sensor 156 for the respective first patch images BC1T, BC1S, BC1G, and BC1K. Specifically, when a detection value for the first patch image BC1 is less than the predetermined reference value, predetermined amounts of toners are supplied to the developing devices 56T, 56S, 56G, and 56K according to the detection value.

[Positional Deviation Adjustment]

Next, description will be made on so-called color registration control, that is, positional deviation adjustment in a sub-scanning direction of an image having superimposed toner images of Y, M, C, W, T, S, G, and K formed by the image forming devices 32 in the image forming unit 30 and the image forming devices 52 in the image forming unit 50. The color registration control in the present exemplary embodiment is performed at exposure timings of the exposure devices 35 and 55.

Specifically, third patch images BC3Y, BC3M, BC3C, BC3W, BC3T, BC3S, BC3G, and BC3K for positional deviation adjustment shown in FIG. 5C are detected by the optical sensors 150, 154, and 156, and exposure timings of the exposure devices 35Y, 35M, 35C, 35W, 55T, 55S, 55G, and 55K are adjusted such that the third patch images BC3Y, BC3M, BC3C, BC3W, BC3T, BC3S, BC3G, and BC3K for position deviation adjustment are at predetermined positions.

In the present exemplary embodiment, it is necessary to perform positional deviation adjustment on the entire image forming unit 30 and the entire image forming unit 50, in addition to the positional deviation adjustment of the image forming devices 32 in the image forming unit 30 and the positional deviation adjustment of the image forming devices 52 in the image forming unit 50.

Positional deviation may be adjusted with any method. In the present exemplary embodiment, the positional deviation is adjusted as follows.

First, positional deviation adjustment is performed on the entire image forming unit 30 and the entire image forming unit 50.

Specifically, the optical sensor 150 detects (i) the third patch image BC3 formed by an image forming device 32 of a predetermined reference color in the image forming unit 30, for example, the third patch image BC3W formed by the image forming device 32W, and (ii) the third patch image BC3 formed by an image forming device 52 of a predetermined reference color in the image forming unit 50, for example, the third patch image BC3K formed by the image forming device 52K, and adjustment is performed such that the third patch image BC3W and the third patch image BC3K have a predetermined positional relationship.

Next, the positional deviation adjustment is performed on the image forming devices 32 of the colors in the image forming unit 30 while the positional deviation adjustment is being performed on the image forming devices 52 of the colors in the image forming unit 50.

Specifically, the optical sensor 154 detects (i) the third patch image BC3W formed by the image forming device 32W, which is a reference of the image forming unit 30, and (ii) the third patch images BC3Y, BC3M, and BC3C formed by the other image forming devices 32Y, 32M, and 32C, and adjustment is performed such that the third patch images BC3Y, BC3M, and BC3C have a predetermined positional relationship with respect to the third patch image BC3W.

Similarly, the optical sensor 156 detects (i) the third patch image BC3K formed by the image forming device 52K, which is a reference of the image forming unit 50, and (ii) the third patch images BC3T, BC3S, and BC3G formed by the other image forming devices 52T, 52S, and 52G, and the third patch images BC3T, BC3S, and BC3G are adjusted to have a predetermined positional relationship with respect to the third patch image BC3K.

<Effects>

Next, effects of the present exemplary embodiment will be described.

Compared with a case where only the optical sensor 150 is provided that detects the patch image BC downstream of the most downstream secondary transfer position TK2, the patch images BC that are not influenced by the secondary transfer units 74 and 76 can be detected in the image forming units 30 and 50 that are provided with the optical sensors 154 and 156.

Therefore, the transfer bias applied to the secondary transfer rollers 24 and 25 can be controlled.

Compared with the case where only the optical sensor 150 is provided, accuracies are improved in (i) the control of the development bias applied to the developing rollers 39 and 59 of the image forming devices 32 and 52 in the image forming units 30 and 50 that are provided with the optical sensors 154 and 156, and (ii) the toner supply adjustment of toners to be supplied to the developing devices 36 and 56.

Further, compared with the case where only the optical sensor 150 is provided, when a difference between a detection result of the optical sensor 150 and a detection result of the optical sensors 154 or 156 is greater than the threshold SS, that is, influence of the secondary transfer is great, accuracies are improved in (i) the control of the development bias applied to the developing rollers 39 and 59 of the image forming devices 32 and 52 in the image forming units 30 and 50, and (ii) the toner supply adjustment of toners to be supplied to the developing devices 36 and 56.

The positional deviation adjustment is performed on the entire image forming unit 30 and the entire image forming unit 50 according to the detection result obtained by the optical sensor 150 detecting the third patch image BC3. The positional deviation adjustment of the image forming devices 32 of the colors in the image forming unit 30 is performed according to the detection result obtained by the optical sensor 154 detecting the third patch image BC3, and the positional deviation adjustment of the image forming devices 52 of the colors in the image forming unit 50 is performed according to the detection result obtained by the optical sensor 156 detecting the third patch image BC3.

Therefore, improved are efficiency of the positional deviation adjustment of the image forming devices 32 in the image forming unit 30 and the image forming devices 52 in the image forming unit 50. Further, compared with a case where only the detection result of the optical sensor 150 is used, improved is the efficiency of the positional deviation adjustment of the image forming devices 32 in the image forming unit 30 and the image forming devices 52 in the image forming unit 50.

Since the optical sensor 150 detects the patch image BC secondarily transferred to the transport belt 21 serving as an example of the transfer body, the detection accuracy is improved as compared with a case where the patch image BC secondarily transferred to the recording paper P that has a different surface condition depending on a material thereof is detected.

In the present exemplary embodiment, the optical sensor 150 detects the patch images BC in the vicinity of the support roller 23 in the flat portion 21Q of the transport belt 21. The optical sensor 154 detects the patch image BC in the vicinity of the backup roller 42 in the flat portion 40Q of the intermediate transfer belt 40. The optical sensor 156 detects the patch image BC in the vicinity of the backup roller 62 in the flat portion 60Q of the intermediate transfer belt 60. Therefore, the detection accuracy is improved as compared with a case where the patch image BC is detected at a curved portion or a portion having a large flapping.

Other Exemplary Embodiments

The present disclosure is not limited to the above-described exemplary embodiment.

For example, in the above-described exemplary embodiment, the image forming apparatus 10 includes the two image forming units, that is, the image forming unit 30 and the image forming unit 50. The present disclosure is not limited thereto. Alternatively, the image forming apparatus may include three or more image forming units. Also, the image forming unit 30 has the four image forming devices 32, and the image forming unit 50 has the four image forming devices 52. The present disclosure is not limited thereto. The image forming unit may simply include two or more image forming devices.

Further, at least one of the plural image forming units may include an optical sensor serving as an example of the second detection device. The image forming unit that does not include an optical sensor serving as an example of the second detection device performs all kinds of control using the optical sensor 150 serving as an example of the first detection device. Further, the transfer bias applied to the secondary transfer roller of the secondary transfer unit may not be controlled, or may be controlled in the same manner as the transfer bias of the secondary transfer roller of another secondary transfer unit is controlled.

Here, when a toner image, which is formed by an image forming unit other than the most downstream one, passes through the upstream secondary transfer position, a portion of the toner image may be transferred to the primary intermediate transfer body of the upstream image forming unit. As the number of times a toner image passes through the secondary transfer position increases, the amount of toner transferred to the primary intermediate transfer body of the upstream image forming unit increases. Therefore, in this sense, the most upstream image forming unit having the largest number of times a toner image thereof passes through the secondary transfer position, that is, the most upstream image forming unit largest influenced by the secondary transfer unit may have an optical sensor serving as an example of the second detection device.

The optical sensor 150 serving as an example of the first detection device detects the patch image BC secondarily transferred to the transport belt. The present disclosure is not limited thereto. The optical sensor 150 may detect the patch image BC secondarily transferred to the recording paper P serving as an example of the recording medium.

In the above-described exemplary embodiment, the toner image is secondarily transferred in a direct manner from the intermediate transfer belt of each image forming unit to the recording paper P serving as an example of a recording medium. The present disclosure is not limited thereto. For example, the toner image may be secondarily transferred from the intermediate transfer belt serving as an example of the primary intermediate transfer body of each image forming unit to a secondary intermediate transfer body, and then tertiarily transferred from the secondary intermediate transfer body to the recording medium. In this case, the optical sensor 150 serving as an example of the second detection device may detect the patch image BC secondarily transferred to the secondary intermediate transfer body.

Further, in the above-described exemplary embodiment, the optical sensor 150 includes the three detectors 150A, 150B and 150C arranged side by side at intervals (see FIG. 6), the optical sensor 154 includes three detectors 154A, 154B and 154C arranged side by side at intervals, and the optical sensor 156 includes three detectors 156A, 156B and 156C arranged side by side at intervals. The present disclosure is not limited thereto. The number of the detectors may be one or four or more. When there is one detector, adjustment of transfer conditions of the secondary transfer units, adjustment of the image forming devices, and the positional deviation adjustment of the toner image are performed based on a detection result of the one detector.

Further, the configuration of the image forming apparatus is not limited to the configuration in the above-described exemplary embodiment, and any of various other configurations may be employed. Furthermore, various embodiments of the disclosure may be implemented without departing from the spirit of the disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming units each comprising:

a plurality of image forming devices; and a primary intermediate transfer body configured for toner images formed by the plurality of image forming devices to be primarily transferred to the primary intermediate transfer body;

a plurality of secondary transfer units that are provided for the plurality of image forming units, respectively, each of the secondary transfer units being configured to secondarily transfer the toner images on a corresponding one of the primary intermediate transfer bodies to a transfer body;

a first detection device configured to detect the toner images downstream of a most downstream secondary transfer position;

a second detection device provided in at least one of the image forming units, the second detection device being configured to detect the toner images between a most downstream primary transfer position in the primary intermediate transfer body and a secondary transfer position; and a first adjusting unit configured to adjust transfer conditions of the secondary transfer units using detection results of the first detection device and the second detection device.

2. The image forming apparatus according to claim 1, wherein the second detection device is at least provided in a most upstream image forming unit.

3. The image forming apparatus according to claim 2, wherein the second detection device is provided in each of the image forming units.

4. The image forming apparatus according to claim 1, further comprising:

a second adjusting unit configured to adjust the image forming devices using a detection result of at least one of the first detection device and the second detection device.

5. The image forming apparatus according to claim 4, wherein the first adjusting unit is configured to perform the adjustment if a difference between the detection result of the first detection device and the detection result of the second detection device is greater than a threshold, and wherein the second adjusting unit is configured to:

perform the adjustment using the detection result of the second detection device if the difference between the detection result of the first detection device and the detection result of the second detection device is greater than the threshold, and perform the adjustment using one or both of the detection results of the first detection device and the detection result of the second detection device if the difference between the detection result of the first detection device and the detection result of the second detection device is equal to or less than the threshold.

6. The image forming apparatus according to claim 1, further comprising:

a position adjusting unit configured to adjust a positional deviation of the toner images formed on the transfer body by the image forming devices, using the detection results of the first detection device and the second detection device.

7. The image forming apparatus according to claim 6, wherein the position adjusting unit is configured to:

use the detection result of the first detection device for adjustment between the plurality of image forming units, and use the detection result of the second detection device to perform the positional deviation adjustment for the plurality of image forming devices of each image forming unit.

8. The image forming apparatus according to claim 1, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

9. The image forming apparatus according to claim 2, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

10. The image forming apparatus according to claim 3, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

11. The image forming apparatus according to claim 4, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

12. The image forming apparatus according to claim 5, wherein the transfer body comprises a transport belt configured to transport a recording medium to which the toner images are transferred, the toner images being capable of being transferred to the transfer body, and the first detection device is configured to detect the toner images transferred to the transport belt downstream of the most downstream secondary transfer position.

13. The image forming apparatus according to claim 6, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

14. The image forming apparatus according to claim 7, wherein the transfer body comprises a transport belt configured to transport a recording medium to which the toner images are transferred, the toner images being capable of being transferred to the transfer body, and wherein the first detection device is configured to detect the toner images transferred to the transport belt downstream of the most downstream secondary transfer position.

15. The image forming apparatus according to claim 1, wherein the transfer body comprises a secondary intermediate transfer body, and wherein the first detection device is configured to detect the toner images transferred to the secondary intermediate transfer body downstream of the most downstream secondary transfer position.

16. The image forming apparatus according to claim 2, wherein the transfer body comprises a secondary intermediate transfer body, and wherein the first detection device is configured to detect the toner images transferred to the secondary intermediate transfer body downstream of the most downstream secondary transfer position.

17. The image forming apparatus according to claim 3, wherein the transfer body comprises a secondary intermediate transfer body, and wherein the first detection device is configured to detect the toner images transferred to the secondary intermediate transfer body downstream of the most downstream secondary transfer position.

18. The image forming apparatus according to claim 4, wherein the transfer body comprises a secondary intermediate transfer body, and wherein the first detection device is configured to detect the toner images transferred to the secondary intermediate transfer body downstream of the most downstream secondary transfer position.

19. The image forming apparatus according to claim 5, wherein the transfer body comprises a secondary intermediate transfer body, and wherein the first detection device is configured to detect the toner images transferred to the secondary intermediate transfer body downstream of the most downstream secondary transfer position.

20. The image forming apparatus according to claim 6, wherein the transfer body comprises a secondary intermediate transfer body, and wherein the first detection device is configured to detect the toner images transferred to the secondary intermediate transfer body downstream of the most downstream secondary transfer position.

21. An image forming apparatus comprising:

a plurality of image forming cartridges, wherein each of the plurality of image forming cartridges comprises:

a plurality of image forming devices, wherein each of the plurality of image forming devices comprises:

a photoconductor;

a charging roller configured to charge a surface of the photoconductor;

a light source; and a developer configured to develop an electrostatic latent image formed by irradiation of the light source;

a primary intermediate transfer belt configured for toner images formed by the plurality of image forming devices to be primarily transferred to the primary intermediate transfer belt;

a plurality of secondary transfer units that are provided for the plurality of image forming cartridges, respectively, each of the secondary transfer units being configured to secondarily transfer the toner images on a corresponding one of the primary intermediate transfer belts to a secondary transfer belt;

a first optical sensor configured to detect the toner images downstream of a most downstream secondary transfer position;

a second optical sensor provided in at least one of the image forming cartridges, the second optical sensor being configured to detect the toner images between a most downstream primary transfer position in the primary intermediate transfer belt and a secondary transfer position; and a controller configured to adjust transfer conditions of the secondary transfer units using detection results of the first optical sensor and the second optical sensor.

* * * * *